United States Patent [19]

Korpman et al.

[11] 4,388,349

[45] Jun. 14, 1983

[54] EXTRUSION COATING PROCESS

[75] Inventors: Ralf Korpman, Bridgewater; C. Palermo Felice, Asbury, both of N.J.

[73] Assignee: Permacel, New Brunswick, N.J.

[21] Appl. No.: 402,768

[22] Filed: Jul. 28, 1982

Related U.S. Application Data

[63] Continuation-in-part of Ser. No. 209,161, Nov. 21, 1980, abandoned.

[51] Int. Cl.[3] ..... B05D 5/10
[52] U.S. Cl. ..... 427/208.4
[58] Field of Search ..... 427/208.4

[56] References Cited

U.S. PATENT DOCUMENTS

| | | | |
|---|---|---|---|
| 2,774,327 | 12/1956 | Saint-Hilaire | 118/68 X |
| 3,783,072 | 1/1974 | Korpman | 156/244.23 |
| 3,984,509 | 10/1976 | Hall et al. | 264/40.1 |

*Primary Examiner*—Bernard D. Pianalto
*Attorney, Agent, or Firm*—Dressler, Goldsmith, Shore, Sutker & Milnamow, Ltd.

[57] ABSTRACT

A process of extrusion coating which is particularly useful in the manufacture of viscous pressure-sensitive adhesive sheets and tapes is described. In the process, the distance between the die orifice and contacting substrate, and spaced coating roll and the relationships between the direction of extrusion, the direction of approach of the substrate and the direction of departure of the coated substrate are important.

9 Claims, 6 Drawing Figures

EXTRUSION COATING PROCESS

This application is a continuation-in-part of application Ser. No. 209,161 filed Nov. 21, 1980, abandoned.

This invention is directed to a process for extrusion coating.

BACKGROUND OF THE INVENTION

Extrusion coating of viscous materials, mainly materials having viscosities in the range of from about 100,000 to 800,000 centipoises at 350° F. such as tacky industrial grade pressure-sensitive adhesive compositions, certain hot melt adhesive compositions and certain intermediate temperature melting thermoplastic film forming compositions, are usually carried out by operations in which the extrudate issues from a die positioned laterally above the bite or nip formed between a highly polished metal chill roll (sometimes called coating roll) bearing the substrate and a rubber or pressure roll, and falls into the nip to be air drawn to the desired film thickness and then laminated onto the substrate. Sometimes, the die has been positioned above the metal chill roll or the pressure roll but nevertheless at a location sufficiently above the roll so that the film curtain is drawn to reduce its thickness while unattached to the substrate. The extruded film curtain is widest as it leaves the die and narrows during its free fall to the substrate. This phenomenon called draw-down or neck-in is dependent on the composition type, melt temperature and distance of the die above the substrate. The neck-in is accompanied by a thickening of the outside edges of the falling curtain. This thickened edge called an edge bead can be from three to six times thicker than the coating thickness. The edge bead must be removed from the coated or laminated substrate in order to eliminate handling problems. The removal which is carried out by trimming off the edge beads represents a major economic loss since no economical way has been found to recover and reuse this material. Not only the bead material but the substrate also must be eliminated and considered a loss. Although ways have been advised to minimize the loss of materials, additional manipulations are necessary and total loss is not avoided.

Additionally, coatings of manufacturing widths (approximately 5 feet) are difficult to obtain and maintain in uniform thickness. Further, with some substrates, good anchorage of the adhesive is difficult to achieve. It is highly desirable to devise a procedure capable of producing a coated product from a highly viscous coating composition of high quality and uniformity, and with minimum economic waste.

STATEMENT OF THE INVENTION

According to the present invention, it has been discovered that a smooth, uniform coating can be obtained from a viscous composition by extruding a hot molten composition onto a substrate through a die positioned directly over a polished metal chill roll or coating roll of an extrusion coating line at a distance which provides a separation between the die lip or die orifice and associated substrate and a spaced chill or coating roll of no greater than about 150 mils and wherein the substrate is drawn to the die orifice from a direction such that the angle formed between a line representing the direction of approach of the substrate and a line representing the direction of extrusion of the extrudate through the orifice is less than 90°, and wherein the substrate is drawn away from the die orifice in a direction such that the angle formed between the direction of extrusion and a line representing the initial departing direction of the coated substrate immediately on formation when combined with the angle formed between a line representing the direction of approach of the substrate and a line representing the direction of extrusion of the extrudate through the orifice is less than 180°. The coated product obtained according to the process of the present invention is of superior quality, having no beading effect at the outer edges. Moreover, it has been found that with some substrates coating may be carried out without the use of pressure rolls and still result in a product in which there is good anchorage of the coating to the substrate. This is especially beneficial when the substrate has low tensile strength so that it may become subject to being torn by the pressure roll.

In addition, the process is also advantageously employed for extrusion coating onto substrates of thermoplastic materials of moderate softening temperatures which are not necessarily of the high viscosity of the adhesive compositions but have properties hereinafter described. When the expression "coating composition" is employed without qualification it is intended to embrace both the viscous adhesive compositions and non-adhesive thermoplastic coating polymers of moderate softening temperatures.

DETAILED DESCRIPTION OF THE INVENTION

In the process of the present invention, viscous materials, materials with viscosity in the order of 100,000 to 800,000 centipoises, may be extruded in the absence of solvent through a die of conventional opening size, e.g., 20 to 50 mils and coated uniformly onto a substrate at a coating thickness as low as about 0.75 mil, generally 0.75 to 6 mils, without the problem of neck-in and/or other nonuniformity encountered when highly viscous material is coated employing conventional procedures of extruding and drawing.

In carrying out the process of the present invention, the component or components of the coating composition, generally in dry particulate form, are fed into an extruder in a conventional manner, the component or components then are advanced forward in the extruder barrel heated at temperatures in the range of 325° F. to 450° F. to produce a molten homogeneous composition, and the composition then passed through an elongated extrusion die directly onto a substrate as it moves past the orifice of said die. ("Coating roll" as herein employed is meant the highly polished metal chill or chrome roll which is normally employed with a rubber or silicone rubber pressure roll for extrusion laminating). The orifice of the die is positioned over the coating roll in such a manner that the distance between the die orifice and associated substrate and the spaced chill roll will not be greater than about 150 mils. Further, the substrate is caused to be drawn to the die orifice from a direction such that the angle formed between a line representing the direction of approach of the substrate and a line representing the direction of extrusion of the composition through the orifice is less than 90°. Still further, the coated substrate must be drawn away from the die orifice in a direction such that the angle formed between a line representing the direction of extrusion and a line representing the initial exiting or departing direction of the coated substrate immediately on formation when combined with the angle formed between a line representing the direction of approach of the substrate and a line representing the direction of extrusion of the extrudate through the orifice is less than 180°. This results in the substrate being wrapped about and in contact with the die lips in the area of the die orifice opening (See FIG. 2). The extruded material forces the substrate away from the orifice and results in a uniform coating on the substrate.

Figures 1, 1A:
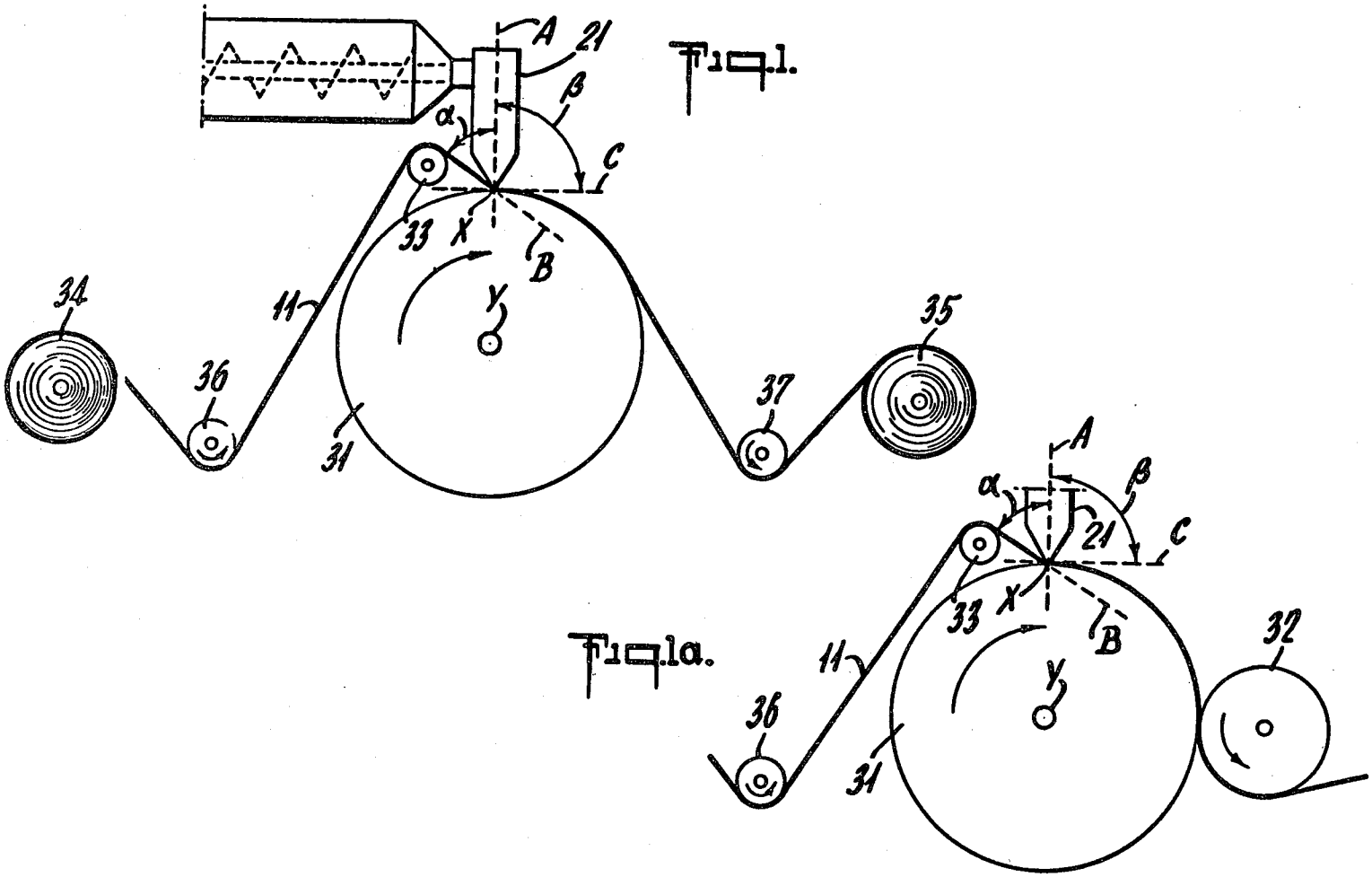
FIG. 1 is a schematic end view of a portion of an extrusion apparatus for the process of the present invention showing the die, substrate and rolls.
FIG. 1*a* is a schematic end view similar to FIG. 1 but including a pressure roll.

The invention may be understood more clearly by reference to the drawings. In both FIGS. 1 and 1*a*, extrudate 12 is seen issuing from die 21 through die orifice 22 onto substrate 11 passing in contact with the die beneath the die orifice. The incoming substrate touches the lip of the die on the incoming side, and the sheet on the outgoing side is separated from the lip only by the thickness of the coating. The coated substrate then moves to coating roll 31 spaced at a distance no greater than about 150 mils from the surface of the die. (The coating roll generally is coupled and may be of rubber coated metal as well as uncoated metal.) The extrudate 12 forces the substrate away from the die and uniformly coats the moving substrates 11 at X directly beneath the die orifice to form a coated substrate 13. After leaving the die the coated substrate almost immediately contacts the coating roll. This is important in order to minimize sheet fluttering and sheet sagging which results in the most uniform coat being provided. Possible drooling of the adhesive is minimized with the almost instant contact of the coated substrate with the cold roll which acts to rapidly solidify the extrudate.

In order to achieve the aims of the present invention, namely to provide a highly uniform coating with a substantially total absence of neck-in or edge-bead formation, the angular direction of approach of the substrate to the direction of the extrusion as well as the initial angular direction of departure of the newly formed coated substrate to the direction of extrusion is extremely important. Thus, the angle alpha ($\alpha$) formed between a line B representing the direction of the incoming substrate and line A representing the direction of extrusion through the center of the die orifice must be less than 90°. The direction of approach of the incoming substrate is controlled by feed guide roll 33. Similarly, the angle beta ($\beta$) formed between line A along the direction of extrusion and line C in the departing direction of the substrate at the moment after contact by the extrudate, namely, the initial momentary exiting direction of the coated substrate is also critical. The sum of angle $\alpha$ and $\beta$ should be less than 180° which insures that the substrate is in positive engagement with the die lips. This positive contacting relationship insures that the required coating thickness is obtained by the present setting of the tension and speed of the moving substrate combined with the extrusion pressure and the viscosity of the extrudate leaving the die orifice. When the die is positioned so that the die orifice 22 is directed to the center Y of the coating roll 31, the angle $\beta$ formed at X between line A and line C is approximately 90°.

Figure 2:
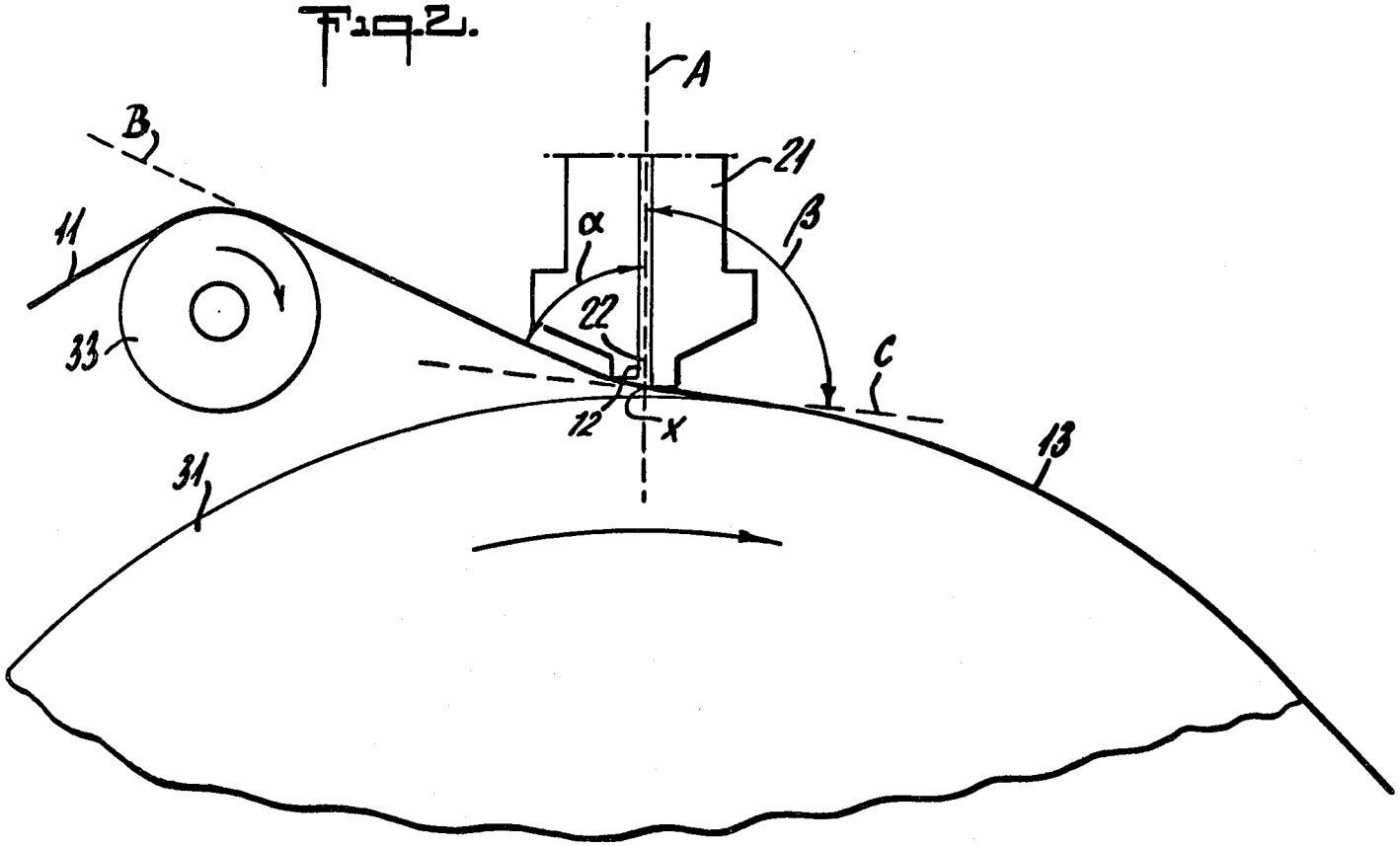
FIG. 2 is an enlarged view at the point of encounter of the extrudate with the substrate.
Figure 3:
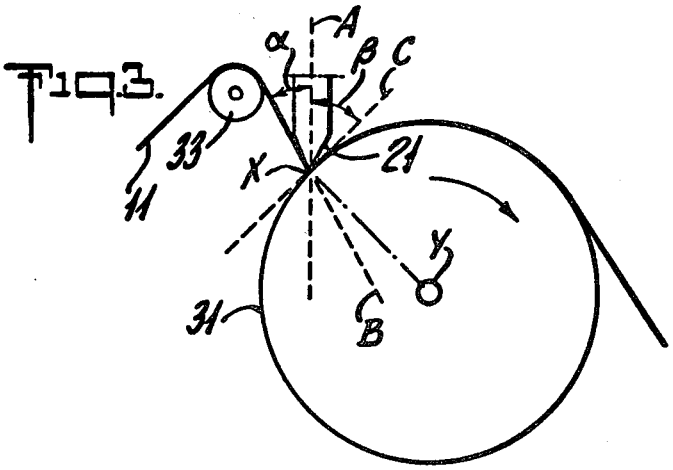
FIG. 3 is a view representing a die positioned off top dead center of the metal chill or coating roll in the upstream direction.
Figure 4:
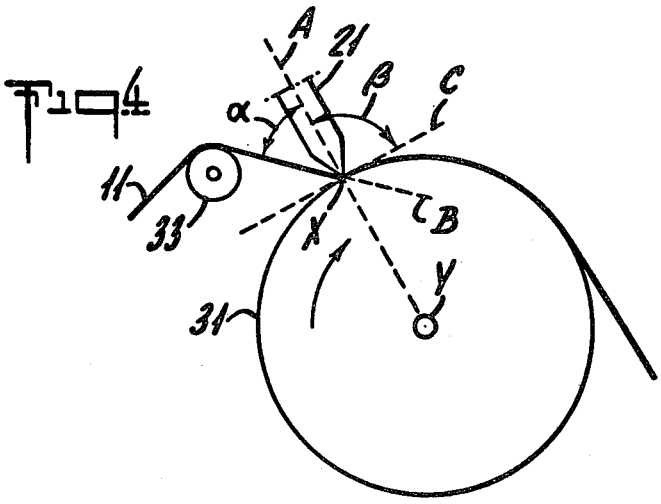
FIG. 4 is a view showing the die at the same position as in FIG. 3 but with the die orifice direction to the center of the coating roll.
Figure 5:
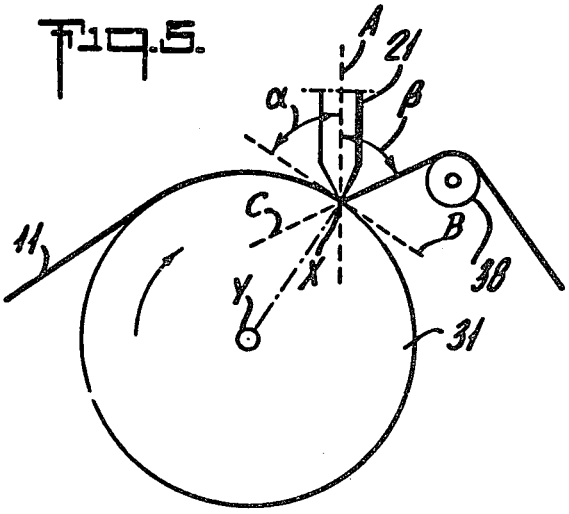
FIG. 5 is a view representing a die positioned off top dead center in the downstream direction.

This is more clearly seen in FIG. 2 wherein substrate 11 fed from feed guide roll 33 moves toward the die 21 along hypothetical line B. Extrudate 12 issues from orifice 22 of die 21 along hypothetical line A contacting substrate 11 at point X no greater than about 150 mils above the circumference of the coater roll 31. Angle $\alpha$ is formed between lines A and B at X. The moving direction of the coated substrate 13 at point X is along line C and the angle formed between A and C is $\beta$. In this embodiment depending on the diameter of the coating roll 31 the angle $\beta$ will be slightly in excess of 90° but the sum of angles $\alpha$ and $\beta$ will be less than 180°. FIG. 3 shows a modification in which the die 21 is positioned off top dead center (12 o'clock) of the coating roll in the upstream direction and directed downward and not to the center of the roll. FIG. 4 shows a modification in which the position of die 21 with respect to the circumference of the chrome roll is substantially the same as in FIG. 3 but in which the direction of the die orifice or line A is toward the center Y of the roll. FIG. 5 shows a modification in which die 21 is positioned off top dead center in the downstream direction of the coating roll. When the die is positioned downstream and is directed downward instead of toward the center, it is necessary to provide guide roll 38 to assure that the sum of angles $\alpha$ and $\beta$ is less than 180°. These latter illustrations represent some of the modifications which can be made, mainly modifications in the position of the die along the circumference of the coating roll and the direction of the die orifice. These latter modifications may be varied to any position on the circumference provided that angle $\alpha$ is always less than 90° and the sum of angles $\alpha$ and $\beta$ is less than 180°.

Not only are the angles $\alpha$ and $\beta$ important but as previously indicated the spacing from the die orifice to the coating roller is also important. The distance should not be greater than about 150 mils. Thus after leaving the die the coated substrate almost immediately contacts the chill roll which acts to rapidly solidify the substrate and minimize drooling. This very small spacing between die and coating roll further insures uniform coating by minimizing sheet fluttering and sheet sagging.

In the coated substrate, the thickness of the coating depends on the speed of the moving substrate and the extruder throughput rate. Typically the die has an orifice of 20 to 50 mils at ambient temperature. It is to be understood that under conditions of extrusion, which are generally in the temperature range of about 325°–450° F., there is expansion of the metal and the die orifice is slightly larger than the cold dimensions. The extrusion assembly may be operated at a linear speed of about 50 feet to about 1000 feet per minute. The actual linear speed will vary depending on the diameter of the extruder barrel which determines throughput rate, the slot width of the die which determines substrate width, and the coating thickness desired. Extruder barrels are commonly available in various diameter sizes, e.g., 3½ inch with throughput rate of 600 pounds per hour, and 4½ inch, 6 inch, 8 inch, etc., with higher throughput rates. One typical commercial slot width is 60 inches. Typically, coating thicknesses are 0.5 to 1.5 mils for film substrate, 1 to 2 mils for paper substrate, 2 to 3 mils for reinforced film substrate, and 3 to 4 mils for cloth substrate. Thus, for example, to obtain a coating of one ounce per square yard (approximately 1 mil in thickness) at a 58 inch width, the linear speed on a 3½ inch extruder may be 298 feet per minute and on a 4½ inch extruder, 596 feet per minute.

The viscous materials to which the process of the present invention is primarily directed are adhesive compositions and certain thermoplastic materials and compositions having moderate softening temperatures, i.e. in the range of about 325° F. to about 450° F. Industrial grade high performance pressure-sensitive adhesive coated sheets and tapes are particularly suited to be advantageously manufactured by the process of the present invention.

The extrudable high performance industrial pressure-sensitive adhesives contemplated to be employed are generally a mixture comprising an elastomer component and a tackifier resin component, such compositions having viscosities in the range of from about 100,000 to about 800,000 centipoises at 350° F.

The elastomer in such adhesive compositions is characterized by having thermoplastic properties. Thus, the elastomer component which may be a mixture of elastomers necessarily contain materials known in the art as thermoplastic elastomers or thermoplastic rubbers. These rubbers generally begin to soften at about 200° F. (93° C.) and have a softening temperature maximum of about 450° F. (232° C.). The most useful and best known of these thermoplastic elastomers are block copolymers which may be those referred to as A-B-A block polymer or as A-B block copolymer in which A designates a thermoplastic block and B designates an elastomeric block. In the A-B-A block copolymers, the terminal or end polymer blocks are the thermoplastic blocks and the middle or internal blocks are the rubbery blocks. In the A-B block copolymers the B block forms one of the end blocks rather than a mid-block. The thermoplastic A block is a polymer of alkenylarene, preferably styrene or styrene homolog or analog. The B block is a polymer of an unsaturated aliphatic hydrocarbon of 4 to 6 carbon atoms, preferably of a conjugated aliphatic diene and most frequently a polymer of butadiene or isoprene. B also may be a polymer of a lower alkene such as ethylene or butylene. The A-B-A block copolymers may be any variation of linear, branched, or radial copolymers with rubbery mid-blocks and thermo-plastic end-blocks, including those sometimes designated as A-B-C block copolymers in which C is a thermoplastic end-block but of a different polymer than A. The radial or teleblock copolymers are sometimes designated $(A\text{-}B)_nX$ wherein X is an organic or inorganic whole functional atom or molecule, n is an integer corresponding to the value of the functional group originally present in X, and in which (A-B) radiates from X in a way that A is an end block. The A-B-A block copolymers employed as the elastomer component generally are those in which the individual A block has a number of average molecular weight of at least 6000, usually from about 8000 to 30,000 and constitute from about 5 to 50 percent, usually about 10 to 30 percent by weight of the A-B-A block copolymer. The B block portion has a number of average molecular weight in the range of from about 45,000 to about 180,000. The number average molecular weight of the entire block copolymer may be in the range of about 75,000 to 200,000 when linear or branched, and about 125,000 to 400,000 when radial. Usually, the linear and branched copolymers are in the range of 100,000 to 150,000 and the radial in the range of 150,000 to 250,000. In A-B block copolymers, the number average molecular weight of the A block is generally from about 7000 to about 20,000 and the total molecular weight usually does not exceed about 150,000.

Suitable thermoplastic elastomeric block copolymers are prepared by stepwise solution polymerization of the components. They are also available commercially. The preparations and properties of block copolymers are amply described in the literature such as, for example, "Thermoplastic Rubber (A-B-A Block Copolymers) in Adhesives" by J. T. Harlan, et al., in "Handbook of Adhesives" edited by Irving Skeist, Van Nostrand Reinhold Co., New York, Second Edition (1977), pages 304–330; "Rubber-Related Polymers, I. Thermoplastic Elastomers" by W. R. Hendricks, et al., in "Rubber Technology" edited by Maurice Morton, Van Nostrand Reinhold Co., New York (1973), pages 515–533; and U.S. Pat. Nos. 3,519,585; 3,787,531; and 3,281,383; and for A-B block copolymers, U.S. Pat. Nos. 3,519,585 and 3,787,531.

When the thermoplastic elastomer is a block copolymer, it may be an A-B-A or an A-B block copolymer or a mixture of the two types. When the A block is polystyrene and B block is polyisoprene, the elastomers are referred to as an S-I-S block copolymer or S-I block copolymer. When the A block is polystyrene and the B block is polybutadiene, the elastomers are known as S-B-S or S-B block copolymer.

When the A-B-A block copolymer or A-B block copolymer is used as the primary elastomer of the elastomer component, the component may be modified by the addition of from 0 to 25 percent by weight based on the weight of the thermoplastic elastomer, of a more conventional diene elastomer such as natural rubber, polymers based on butadiene or isoprene, butadiene-styrene (SBR) rubber, butadiene-acrylonitrile (NBR) rubber, butyl rubber and the like, provided they are in a low plasticity state, e.g., less than about 40 Mooney units.

Additionally, the elastomer component may be an ethylene vinyl acetate copolymer (EVA) copolymer. These are generally random copolymers containing from about 28 to 60 percent vinyl acetate by weight. These may be used singly, as mixtures of ethylene vinyl acetate polymers or as mixture with A-B-A or A-B block copolymers.

The tackifying resin for the tackifier component may be a natural or synthetic polymer, preferably solid having a softening point in the range of about 85° C. to about 150° C. and includes rosin, hydrogenated rosin, dehydrogenated rosin, rosin esters such as erythritol and glycerol esters, 1 polymerized alpha or beta pinene, polymerized mixture of piperlyene and isoprene, and the like. Other materials are described in the chapter entitled "Pressure-Sensitive Tapes and Labels" by C. W. Bemmels in "Handbook of Adhesives" edited by Irving Skeist, Van Nostrand Reinhold Co., (1977) pages 724–735. In addition to the foregoing, the adhesive compositions may include other conventional additives such as antioxidants, heat stabilizers, ultraviolet absorbers, pigments, inorganic fillers, parting agents and the like.

Representative of some of the adhesive compositions which may be advantageously employed in the process of the present invention include compositions which are described in U.S. Pat. Nos. 3,783,072 and 3,984,509.

The process is also adaptable to being employed for use with coating materials which are not adhesive compositions. Coating materials which may beneficially employ the process of the present invention include certain copolyesters, certain modified ethylene polymers and other thermoplastic materials which have a torque value not to exceed 600 meter grams when measured by working at 220° C. at 75 r.p.m. in a recording torque dynamometer (Plasti-Corder EPL-V750 manufactured by C. W. Brabender Co., Hackensack, N.J.).

Copolyesters are copolymers of:

$$+\overset{O}{\overset{\|}{C}}-X-\overset{O}{\overset{\|}{C}}-O-Y-O+ \text{ and } +\overset{O}{\overset{\|}{C}}-X'-\overset{O}{\overset{\|}{C}}-O-Y'-O+$$

wherein X and X' are nuclei of aromatic or aliphatic dicarboxylic acids and Y and Y' are nuclei of alkylene diols. Those copolymers which are of high viscosity and moderate softening temperature in the range hereinbefore indicated are adaptable to being employed in the present process. Other coating materials which may be usefully employed include low melting modified polyethylene and ethylene vinyl acetate having a vinyl acetate content of 20 percent or higher.

The invention is a useful coating process employing materials whether adhesive or not which are highly viscous, e.g., having a viscosity higher than 100,000 centipoises and not previously considered suitable for extrusion coating provided they have moderate softening temperatures, e.g., not above about 450° F. (232° C.). Coating and/or adhesive materials of low viscosity also may be employed in the process of the present invention although for these materials, other methods not adaptable to highly viscous compositions are available for achieving uniform coating.

The following examples illustrate the invention but are not construed as limiting:

EXAMPLES I–VIII

Pressure sensitive adhesive coated substrates are prepared by feeding the component materials indicated in Table A (in parts by weight) into an extruder, mixing and melting at temperatures in the range of from about 350° to 425° F., and extruding through a die orifice of 20 mils onto various substrates. Suitable substrates are paper, polyvinyl chloride, cloth, polyester and aluminum foil. The coated substrates have adhesive film thickness of less than 5 mils and are uniform throughout with substantially no beading effect. The coated substrates are slitted to form pressure-sensitive adhesives tapes of good adhesion and hold.

TABLE A

| | EXAMPLES | | | | | | | |
|---|---|---|---|---|---|---|---|---|
| COMPONENTS | I | II | III | IV | V | VI | VII | VIII |
| S-I-S Linear block copolymer[1] | 100 | | | | 70 | | | |
| S-B-S Linear block copolymer[2] | | 100 | | | | | | |
| S-I-S Radial block copolymer[3] | | | 100 | | | | | |
| S-B-S Radial block copolymer[4] | | | | 100 | | | | |
| S-B Linear block copolymer[5] | | | | | 30 | | | |
| S-I Linear block copolymer[6] | | | | | | 100 | | |
| S-PB-S Linear block copolymer[7] | | | | | | | 100 | |
| Ethylene vinyl acetate copolymer[8] | | | | | | | | 100 |
| Piperylene-isoprene tackifier (soft. pt. 95° C.)[9] | 80 | | | | 50 | 40 | 100 | |
| Piperylene-isoprene tackifier (soft. pt. 76° C.)[10] | | 70 | | | | | | |
| Polyterpene tackifier (soft. pt. 115° C.)[11] | | | 60 | | | | | |
| Polymerized mixed olefin tackifier (soft. pt. 80° C.)[12] | | | | 80 | | | | |
| Pentaerythritol ester of stabilized rosin tackifier (soft. pt. 94° C.)[13] | | | | | 30 | | | 80 |
| Coumarone-indene resin tackifier (soft. pt. 145° C.)[14] | | | | | | 20 | | |
| Piperylene-isoprene liquid tackifier (soft. pt. 10° C.)[15] | | | | | | | 50 | |
| Glycerol ester of hydrogenated rosin liquid tackifier (soft. pt. 10° C.)[16] | | | | | | | | 20 |
| Zinc dibutyl dithiocarbamate (antioxidant) | 2 | 2 | 2 | 2 | 2 | 2 | 2 | 2 |
| 2,5-Ditertiary amylhydroquinone (antioxidant) | 0.5 | 0.5 | 0.5 | 0.5 | 0.5 | 0.5 | 0.5 | 0.5 |

FOOTNOTES TO TABLE A

[1]Kraton 1107, Shell Chemical Company
[2]Kraton 1102, Shell Chemical Company
[3]Solprene 418X, Phillips Petroleum Company
[4]Solprene 411, Phillips Petroleum Company
[5]Solprene 1205, Phillips Petroleum Company
[6]Solprene 311, Phillips Petroleum Company
[7]Kraton G1650, Shell Chemical Company
[8]EVA No. 105 (60% ethylene, 40% vinyl acetate), E. I. duPont de Nemours & Company
[9]Wingtack 95, Goodyear Tire and Rubber Company
[10]Wingtack 76, Goodyear Tire and Rubber Company
[11]Piccolyte S115, Hercules Chemical Company
[12]Super-Statac 80, Reichold Chemical Company
[13]Foral 105, Hercules Chemical Company
[14]Cumar 509LX, Neville Chemical Company
[15]Wingtack 10, Goodyear Tire and Rubber Company
[16]Staybelite Ester No. 3, Hercules Chemical Company

EXAMPLES IX-X

In separate operations, poly(ethylene terephthalate-coethylene azelate) of apparent molecular weight of about 20,000 (VPE 5571, Goodyear Tire and Rubber Company) and modified polyethylene of apparent molecular weight of 8000, viscosity of 8500 centipoises at 150° C., and softening point of about 106° C. (EPOLENE wax C-16, Eastman Kodak Company) are fed into the hopper of an extruder and heated at about 350° F. and extruded through the die onto a paper substrate to obtain copolyester and modified polyethylene coated paper respectively with substantially no beading effect. The coated films may be used as substrates for adhesive tapes as well as for waterproof coverings.

EXAMPLE XI

In separate operations, adhesive coated sheets of SBR latex saturated paper coated on the back side with a release agent (stearyl methacrylate—acrylonitrile blended with resin film former, U.S. Pat. No. 3,502,497, Example VIII), and 0.88 gauge Mylar polyester film coated on the back side with a release agent (stearyl methacrylate—acrylonitrile, U.S. Pat. No. 3,502,497, Example I) to be slitted in the manufacture of pressure-sensitive tapes are prepared first by feeding into the hopper of an extruder, the following components (in parts by weight):

| | |
|---|---|
| S-I-S linear block copolymer (Kraton 1107) | 100 |
| Piperylene-isoprene tackifier (Wingtack 95) | 80 |
| Zinc dibutyl dithiocarbamate | 2 |
| 2,5-Ditertiary amylhydroquinone | 1 |

The components then are mixed and melted at barrel temperatures ranging from 160° to 230° C. and extruded through a die orifice of about 20 mils onto the paper substrate and the film substrate to obtain adhesive film coated sheets of adhesive film thickness of 1.5 mils for paper substrate, and 0.75 mil for polyester film substrate. All coated sheets obtained are of good uniformity with no beading effect, i.e., substantially no thickening along the edges.

EXAMPLE XII

In a similar operation, an adhesive coated sheet of polyethylene coated cotton cloth is prepared by extruding an adhesive mixture of the following composition (parts by weight).

| | |
|---|---|
| S-I-S block copolymer (Kraton 1107) | 50 |
| S-I linear block copolymer (Solprene 311) | 50 |
| Piperylene-isoprene tackifier (wingtack 95) | 80 |
| Zinc dibutyl dithiocarbamate | 2 |
| 2,5-Ditertiary amylhydroquinone | 1 |

The components are mixed and melted in the temperature range 160° to 230° C. and extruded through a 20 mil die orifice to obtain a 3.5 mil adhesive film on a cloth substrate of uniform thickness and substantially free of any beading effect.

EXAMPLE XIII

In still another similar operation, a saturated paper substrate described in Example XI is coated with an adhesive mixture of the following composition:

| | |
|---|---|
| S-I-S plus S-I block copolymer blend* | 100 |
| Piperylene-isoprene tackifier | 80 |
| Zinc dibutyl dithiocarbamate | 2 |
| 2,5-Ditertiary amylhydroquinone | 1 |

*Kraton 1112, thought to be about 70 parts S-I-S and 30 parts S-I copolymers

The components are mixed, melted and extruded as previously described to obtain a 1.5 mil adhesive coated paper substantially free of any beading effect.

What is claimed is:

1. A direct extrusion process for preparing a coating substrate from a viscous coating composition which comprises:
   (a) feeding the component material or materials of a coating composition into an extruder,
   (b) advancing the material or materials forward in the extruder barrel to obtain a molten homogeneous composition, and then through an elongated extrusion die orifice leading from said extruder barrel,
   (c) directing a substrate into positive engagement with the outlet opening defined by said extrusion die,
   (d) extruding the homogeneous composition through the extrusion die orifice onto the substrate to force the substrate away from said die and forming a uniform coating on said substrate, moving the coated substrate into immediate contact with a closely disposed coating roll, said substrate being drawn to the die orifice from a direction such that the angle $\alpha$ formed between a line representing the direction of approach of the substrate and a line representing the direction of extrusion is less than 90°, and said coated substrate is drawn away from the die orifice in a direction such that the angle $\beta$ formed between the direction of extrusion and a line representing the initial departing direction of the coated substrate immediately on formation when combined with the angle $\beta$ is less than 180°.

2. A process according to claim 1 wherein the maximum distance between the die orifice and the coating roll is about 150 mils.

3. A process according to claim 1 wherein the angle $\beta$ is approximately 90°.

4. A process according to claim 1 wherein the angle $\beta$ is less than 90°.

5. A process according to claim 1 wherein the angle $\beta$ is slightly greater than 90°.

6. A process according to claim 1 wherein the composition is of a viscosity in the range of from about 100,000 centipoises to about 800,000 centipoises at 350° F.

7. A process according to claim 1 wherein the coating is of a thickness in the range of from about 0.75 to 5 mils.

8. A process according to claim 1 wherein the extrusion is carried out in the temperature range of from about 325° F. to about 450° F.

9. A process according to claim 1 wherein the coating is an adhesive composition.

* * * * *